US006874975B2

(12) United States Patent
Hilfiker et al.

(10) Patent No.: US 6,874,975 B2
(45) Date of Patent: Apr. 5, 2005

(54) SOIL-NAIL APPARATUS AND METHOD FOR CONSTRUCTING SOIL REINFORCED EARTHEN RETAINING WALLS

(75) Inventors: William B. Hilfiker, Fortuna, CA (US); Enayat S. Aziz, Redmond, WA (US)

(73) Assignee: Hilfiker Pipe Company, Eureka, CA (US)

( * ) Notice: Subject to any disclaimer, the term of this patent is extended or adjusted under 35 U.S.C. 154(b) by 0 days.

(21) Appl. No.: 10/314,784

(22) Filed: Dec. 9, 2002

(65) Prior Publication Data

US 2004/0109729 A1 Jun. 10, 2004

(51) Int. Cl.[7] ..... E02D 29/02
(52) U.S. Cl. ..... 405/262; 405/284
(58) Field of Search ..... 405/262, 284, 405/285, 286, 287, 259.1–259.6

(56) References Cited

U.S. PATENT DOCUMENTS

| | | | | | |
|---|---|---|---|---|---|
| 1,270,659 | A | | 6/1918 | Ravier | |
| 3,999,391 | A | | 12/1976 | Meredith | 61/39 |
| 4,325,657 | A | * | 4/1982 | Elders | 405/302.1 |
| 4,329,089 | A | | 5/1982 | Hilfiker et al. | 405/262 |
| 4,343,572 | A | | 8/1982 | Hilfiker | 405/284 |
| 4,397,589 | A | | 8/1983 | Darroussin et al. | 405/260 |
| 4,718,792 | A | * | 1/1988 | Louis | 405/262 |
| 4,834,582 | A | | 5/1989 | Bullivant | 405/230 |
| 4,952,097 | A | | 8/1990 | Kulchin | 405/262 |
| 4,997,316 | A | | 3/1991 | Rose | 405/284 |
| 5,044,831 | A | * | 9/1991 | Myles et al. | 405/259.1 |
| 5,395,185 | A | * | 3/1995 | Schnabel, Jr. | 405/287 |
| 5,588,784 | A | * | 12/1996 | Brandl et al. | 405/262 |
| 5,669,737 | A | | 9/1997 | Equilbec et al. | 405/262 |
| 5,688,077 | A | * | 11/1997 | Kynoch | 405/259.5 |
| 5,921,715 | A | * | 7/1999 | Rainey | 405/262 |
| 5,927,905 | A | | 7/1999 | van Halteren | 405/252.1 |
| 6,089,792 | A | * | 7/2000 | Khamis | 405/262 |
| 6,168,351 | B1 | | 1/2001 | Rainey | 405/262 |
| 6,299,386 | B1 | * | 10/2001 | Byrne et al. | 405/273 |
| 6,371,699 | B1 | * | 4/2002 | Weinreb | 405/262 |
| 6,565,288 | B1 | * | 5/2003 | McCallion | 405/259.5 |

FOREIGN PATENT DOCUMENTS

| | | | | |
|---|---|---|---|---|
| AU | 630660 | * | 8/1991 | 405/259.5 |

OTHER PUBLICATIONS

Marcus H. Von Der Hofen "Soil Nailing is Designed to Fit" Article in Shotcrete Magazine, Summer 2001.
Natalie Goldstein "Soil Nailing" Article in Erosion Control Magazine, Sep./Oct. 2001 Issue.
Web Page of Williams Form Engineering Corp. "Soil Nail Anchor Systems" 2002 (2 pages).
Web Page of Williams Form Engineering Corp. "Soil Nail Anchor Systems Applications" 2002 (3 pages).
Nicholson, A Rodio Group Company "Soil Nails" Not Dated (2 pages).

* cited by examiner

*Primary Examiner*—Frederick L. Lagman
(74) *Attorney, Agent, or Firm*—John K. Uilkema; Thelen Reid & Priest LLP

(57) ABSTRACT

A soil reinforced retaining wall for an earthen embankment is formed by screwing nails into the embankment at spaced intervals. The nails have helical threads extending therearound of such proportion and pitch as to screw into the formation as the nails are driven into place with a vibratory hammer, without prior boring of the embankment to accommodate the nails, or the necessity of cementing the nails into place. The wall is constructed from the top down and face panels are progressively assembled over the embankment and secured in place by the nails. In a preferred embodiment the nails have an elongate tubular body of a polyhedral cross-section and the threads are formed by twisting the body about its longitudinal axis.

20 Claims, 12 Drawing Sheets

SOIL-NAIL APPARATUS AND METHOD FOR CONSTRUCTING SOIL REINFORCED EARTHEN RETAINING WALLS

The present invention relates to the construction of soil reinforced earthen retaining walls and, more particularly, is directed to an apparatus and method for constructing such walls through the use of specially constructed nails formed with helical threads which screw the nails into the formation as they are driven into place. It is also concerned with a method for constructing such nails and a top-down system for constructing soil reinforced earthen retaining walls wherein the soil at the face of the upper levels of the wall is retained prior to construction of the lower levels.

BACKGROUND OF THE INVENTION

Soil-nailing is a process of construction which reinforces the existing ground with tensile strength. In the process, nails are inserted into the soil in a closely spaced pattern to increase the overall shear strength of the earthen formation being treated. The nails are "passive" in that they are not pretensioned and develop tension as the ground deforms laterally in response to ongoing excavation. Most earthen retaining walls formed by the soil-nailing process are provided with temporary or permanent facing in the form of reinforced shotcrete. For permanent walls, a decorative facing is sometimes added.

As contrasted to more conventional reinforced soil retaining walls, soil-nail walls are constructed from the top down. Excavation occurs one layer at a time, from the top of the wall. As each layer is excavated, the nails are installed and facing is added. Successive layers are similarly constructed.

The soil-nails of the prior art comprise straight steel bars constructed of ductile steel and having a length of 60 to 100 percent of the height of the wall being constructed. Typical nails currently in use are categorized as follows:

Driven nails These nails are driven into place with a pneumatic or hydraulic hammer and may have an axial channel to permit the addition of grout sealing. They are generally small diameter (15–46 mm), with a relatively limited length up to about 20 m.

Grouted nails: These nails are inserted into preformed bore holes and then cement grouted. They may be ribbed to increase soil adhesion.

Jet grouted nails. These nails are installed using a high frequency Vibropercussion hammer, and cement grouting is injected during installation.

Launched nails. These nails are typically between 25 and 38 mm in diameter and up to 6 mm or longer and are fired directly into the soil with a compressed-air launcher.

As contrasted to the present invention, these prior soil-nails do not screw into place to directly grip and adhere to the soil continually and evenly over their entire length.

SUMMARY OF THE INVENTION

The nail of the invention comprises an elongate body having proximal and distal ends and a generally spiral-shaped thread extending therearound of such proportions and pitch that the nail will turn and screw into place in an earthen formation in response to being driven into the formation by an impact or vibratory hammer. A tip on the distal end facilitates penetration of the nail into the formation. An impact surface for the driver is provided on the proximal end of the nail. In the preferred embodiments, the body is of a tubular polyhedral cross-section and twisted about its longitudinal axis to provide the spiral-shaped thread.

The soil reinforced retaining wall of the invention comprises an embankment with successive upper and lower courses. The nails are driven into the face of the embankment so as to screw into place and reinforce the soil. Face elements in the form of welded wire mats or preformed concrete panels are secured in place over the embankment by connection to the nails.

The inventive method provides a unique system of soil reinforcement in the construction of an earthen embankment. As a first step to the method, nails are provided having spiral-shaped threads extending therearound of such proportions and pitch that the nails will thread into place in an earthen formation in response to being driven into the formation by rectilinear force. The nails thus provided are driven into the embankment at spaced intervals so as to screw into place and securely mechanically grip the formation. Face elements are then secured into place over the embankment by fastening the elements to the nails.

The invention also provides a method for forming the nails used for soil reinforcement. As a first step, this method provides an elongate generally rectilinear steel tube capable of being plastically deformed by being twisted about its longitudinal axis. Side surfaces of the tube define edges therebetween extending longitudinally of the tube. The tube is twisted about the longitudinal axis to plastically deform the tube into a configuration wherein the side surfaces define a spiral thread extending around the tube.

In one embodiment of the method for forming nails, the tube starts out as being of a circular cross-section and is plastically deformed into a twisted polyhedral cross section having surfaces which define a spiral thread extending around the tube.

A principal object of the invention is to provide a soil-nail of a spiral-shaped configuration capable of screwing into an earthen formation to grip and mechanically adhere to the soil of the formation continually and evenly along the length of the nail.

Another and related object is to provide such a nail wherein the spiral-shaped configuration of the nail is of such proportions and pitch that the nail will screw itself into place in response to being hammered into the face of a formation.

A further object of the invention is to provide an earthen retaining wall and a method of constructing such a wall wherein soil reinforcement is provided by driving spiral-shaped nails into the face of the earthen formation being retained so that the nails securely grip the soil of the formation, with a minimum of disturbance thereto.

Still another object of the invention is to provide a method of fabricating a unique spiral-shaped nail for soil reinforcement wherein the exterior surface of the nail provides a screw thread of such proportions and pitch as to screw into secure engagement with an earthen formation upon being driven laterally into the formation.

Yet another object of the invention is to provide a soil reinforced retaining wall and method for fabricating such a wall wherein the wall is constructed from the top down in successive courses and each course is restrained against sloughing prior to the reinforcement of the course there beneath.

Still another and more specific object of the invention is to provide a method of fabricating a spiral-shaped nail for soil reinforcement wherein the nail is formed from a plastically deformable tubular steel tube twisted about its longitudinal axis.

BRIEF DESCRIPTION OF THE DRAWINGS

The foregoing and other objects will become more apparent when viewed in light of the following detailed description and accompanying drawings, wherein.

DESCRIPTION OF THE PREFERRED EMBODIMENTS

The preferred embodiments of the nail are shown in FIGS. 1 to 14. These figures depict the various cross-sections which the nail may have, from round, to a variety of polyhedral shapes. As used herein, polyhedral is intended to encompass any cross-section where the outer surface of the nail has multiple faces, for example triangular, star-shaped, and any variety of polygon having four or more angles and sides. The faces may be flat or of a variety of curved and/or flat configurations. In certain embodiments, the surfaces are convex, the principle being to provide surfaces and/or edges which may be helically configured to define a screw thread. In the case of the round cross-section, the body of the nail is generally cylindrical and a helical member extends around the body to form the thread.

While the nail may be of various cross-sections, it needs to be of sufficient column strength to enable it to be driven into an earthen formation, with a hammering mechanism such as a vibratory hammer, and to have a helical thread extending therearound, preferably of such proportions and pitch that the nail will turn and screw into place in response to being driven into the formation. Tubular nail configurations having an outside cross-sectional dimension of two to four inches and a wall thickness of one-fourth inch to three-eighths inch have been found to be ideal. The preferred pitch has been found to be between one-quarter and one revolution per lineal foot. A preferred length for the nails is 60 to 80 percent of the wall under construction, with the longest lengths at the top of the wall and the shortest at the bottom. A typical range of length would be from six feet to 50 feet. While the material from which the nails are fabricated may be anything which will provide adequate column and tortional strength to enable the nails to be driven into place; for the twisted polyhedral cross-sections ASTM a 500 grade B has proved ideal. With the preferred cross-sectional dimensions, a tube made of such material may be cold formed into the polyhedral spiral configuration through means of the mechanisms herein described. After fabrication, it is preferably hot-dip galvanized for corrosion resistance.

In the construction of a retaining wall, a plurality of the nails are driven into the wall at spaced intervals. The spacing will depend upon the stability of the formation. Typical spacing is four and a half feet vertically and five feet horizontally.

Nail Configurations

Figure 1:
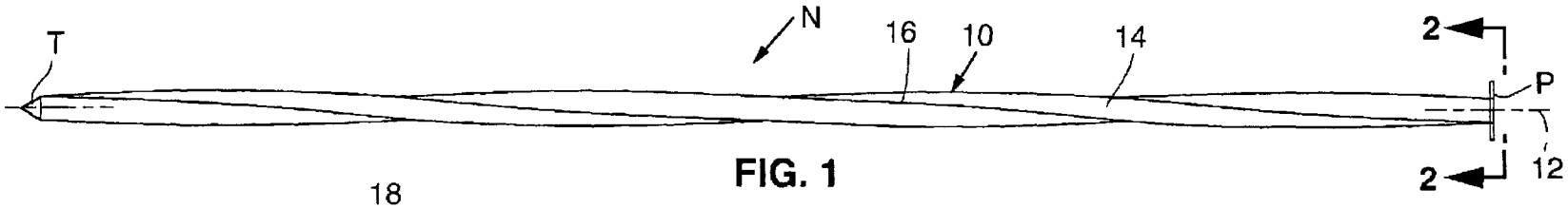
FIG. 1 is a side elevational view of a rectangular nail constructed according to the invention, wherein the nail has a pitch of approximately one revolution per four feet and is provided with a flanged head for attachment of face elements.
Figure 2:
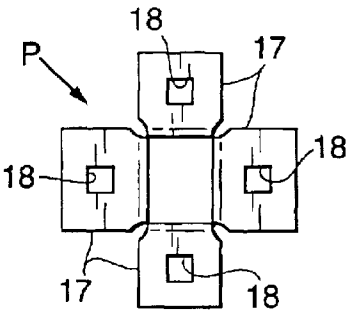
FIG. 2 is end view taken on the plane designated by line 2—2 of FIG. 1.

FIGS. 1 and 2 show an embodiment of the invention wherein the nail, designated N, is of a tubular rectangular configuration having a pointed tip T at its distal end and a flanged proximal end P. As there depicted, the nail N has an elongate body portion 10 with a longitudinal axis 12. The body 10 is twisted about the longitudinal axis so that its sides define continuous helical surfaces extending over the length of the nail. These surfaces, designated 14, intersect at helically extending edges 16.

The flanged proximal end P is discontinuous and formed by cutting the end of the body portion 14 along the intersecting edges 16 and then folding the cut sides 14 outwardly so as to be disposed generally normal to the longitudinal axis 12. The folded sections define a cross-shaped flange made up of tabs 17. Each tab has an opening 18 extending therethrough through which a bolt may be extended for purposes of securing a face element or other structure to the nail. In the preferred embodiment illustrated, the openings 18 are square to accommodate carriage bolts.

Figure 3:
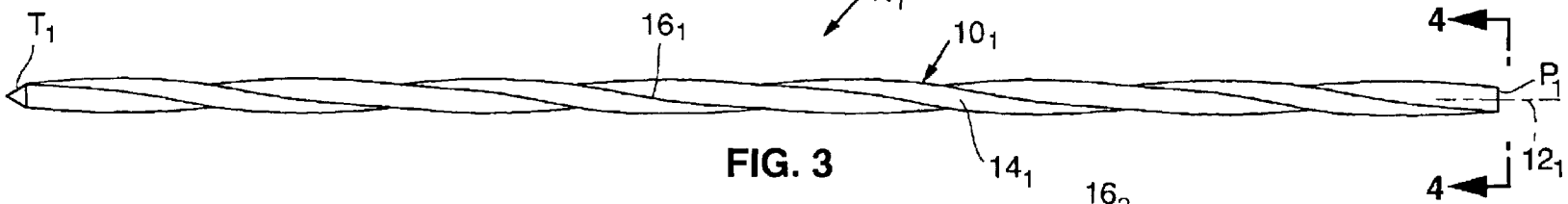
FIG. 3 is a side elevational view of a square nail constructed according to the invention wherein the nail has a pitch of approximately one revolution per foot and is not provided with a flanged end.
Figure 4:
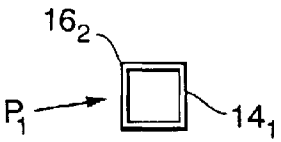
FIG. 4 is an end view taken on the plane designated by line 4—4 of FIG. 3.

The nail of FIGS. 3 and 4, designated $N_1$, is generally similar to that of FIG. 1; except that the rectangular cross-section is square, the nail is not provided with a flange at its proximal end $P_1$, and the pitch of the screw thread formed by the outer surfaces of the nail is approximately one turn per foot. The parts of the FIG. 3 embodiment are designated by letters and numerals corresponding to those of the FIG. 1 embodiment, followed by the subscript 1. These include, in addition to nail $N_1$ and proximal end $P_1$, body portion $\mathbf{10}_1$, longitudinal axis $\mathbf{12}_1$, sides $\mathbf{14}_1$, edges $\mathbf{16}_1$ and tip $T_1$.

Figure 6:
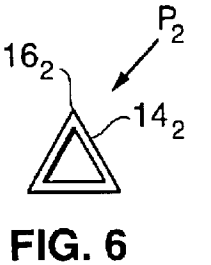
FIG. 6 is an end view taken on the plane designated by line 6—6 of FIG. 5.
Figure 5:
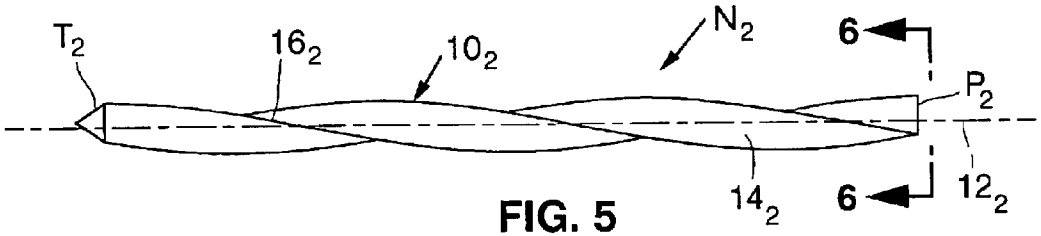
FIG. 5 is a side elevational view of a triangular nail constructed according to the invention.

FIGS. 5 and 6 illustrate a nail $N_2$ having a body portion $\mathbf{10}_2$ of a tubular triangular configuration, with a proximal end $P_2$ and a distal tip $T_2$. The sides of the body portion $\mathbf{10}_2$ are designated $\mathbf{14}_2$ and intersect at edges $\mathbf{16}_2$.

Figure 8:
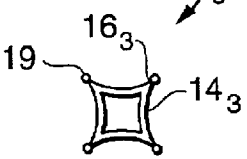
FIG. 8 is an end view taken on the plane designated by line 8—8 of FIG. 7.
Figure 7:
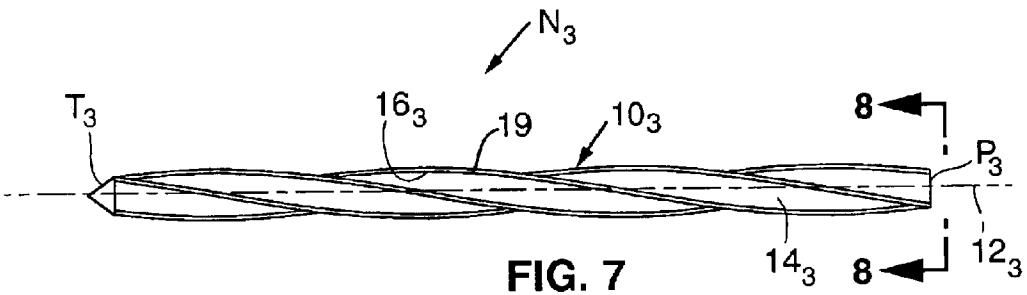
FIG. 7 is a side elevational view of a nail constructed according to the invention wherein the nail is of a generally square cross-section, with concave sides and wires extend along the edges of the nail.

The nail of FIGS. 7 and 8, designated $N_3$, is of a modified tubular square cross-section, as compared to that of FIG. 3. In the modified construction, the sides, designated $\mathbf{14}_3$, are concave so that the edges $\mathbf{16}_3$ are shaper, and wires 19 are welded to and extend along the edges in a helical configuration (see FIG. 8). The longitudinal axis of the FIG. 7 embodiment is designated $\mathbf{12}_3$. The tip and proximal ends are designated $T_3$ and $P_3$, respectively.

Figure 10:
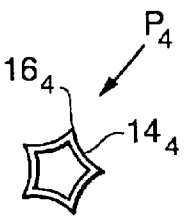
FIG. 10 is an end view taken on the plane designated by line 10—10 of FIG. 9.
Figure 9:
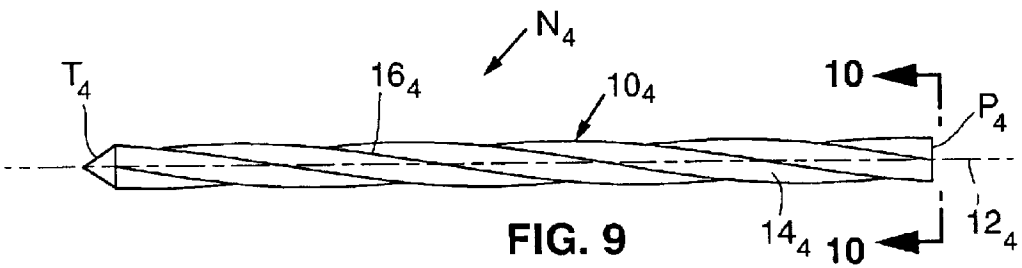
FIG. 9 is a side elevational view of a nail constructed according to the invention, wherein the cross-section of the nail is generally star-shaped, with concave sides.

The nail of FIGS. 9 and 10, designated $N_4$, is of a tubular pentagonal cross-section having concave sides $\mathbf{14}_4$ intersecting at edges $\mathbf{16}_4$. The body portion of the nail $N_4$ is designated 104 and terminates in distal tip $T_4$ and proximal end $P_4$. The longitudinal axis of the body portion $\mathbf{10}_4$ is designated $\mathbf{12}_4$.

Figure 12:
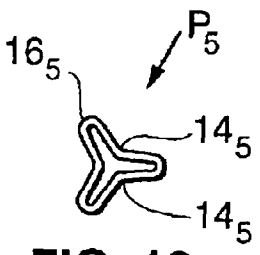
FIG. 12 is an end view taken on the plane designated by line 12—12 of FIG. 11.
Figure 11:
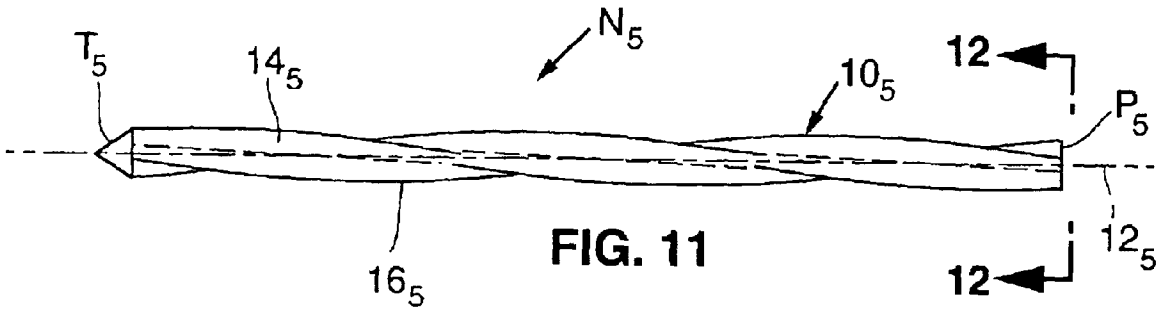
FIG. 11 is a side elevational view of a nail constructed according to the invention wherein the nail is a generally triangular cross-section having pinched in sides.

The nail of FIGS. 11 and 12 is designated $N_5$ and has a body portion $\mathbf{10}_5$ of a generally triangular cross-section having pinched in sides $\mathbf{14}_5$ intersecting at edges $\mathbf{16}_5$. The body $\mathbf{10}_5$ has a longitudinal axis $\mathbf{12}_5$. The distal tip and proximal end of the nail $N_5$ are designated $T_5$ and $P_5$, respectively.

Figure 14:
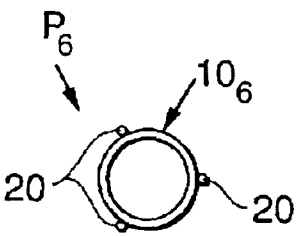
FIG. 14 is an end view taken on the plane designated by line 14—14 of FIG. 13.
Figure 13:
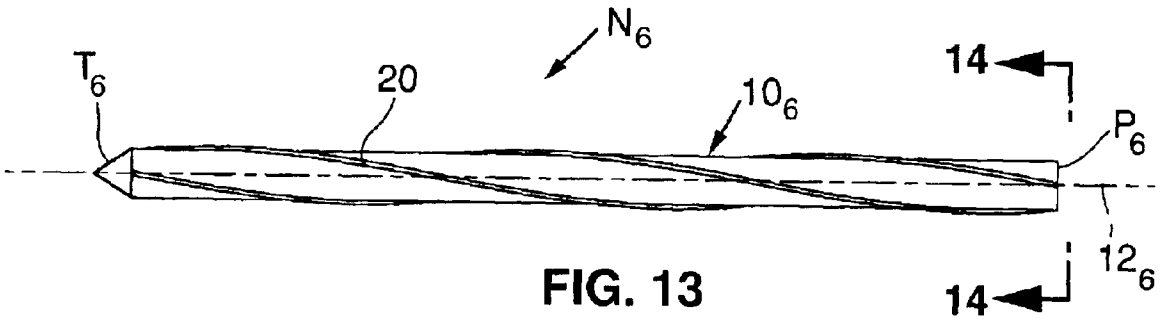
FIG. 13 is a side elevational view of a nail constructed according to the invention wherein the nail is of a round cross-section and the threads are formed by helical wires extending around the body of the nail.

The nail of FIGS. 13 and 14, designated $N_6$, has a cylindrical body portion $\mathbf{10}_6$ of a circular cross-section (see FIG. 14). Wires 20 are fixed to the body portion $\mathbf{10}_6$, by welding for example, and extend over the full length of the body portion to define a helical thread on its outside surface. The tip and proximal ends of the nail $N_6$ are designated $T_6$ and $P_6$, respectively and the axis is designated $T_6$.

Construction of Nail Tip and Proximal End

In the preferred embodiments, the proximal end of the inventive nail is open. Such an open construction is provided both by the flanged proximal end of the FIG. 1 embodiment and the unflanged ends of the embodiments of FIGS. 3, 5, 7, 9, 11 and 13.

Figure 15:
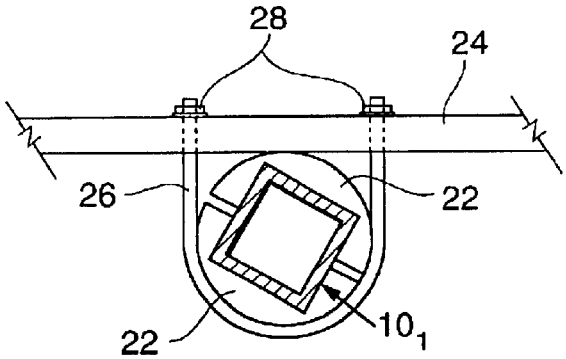
FIG. 15 is a cross-sectional view of a square nail constructed according to the invention, with an end clamp and retaining bar secured to the proximal end of the nail.
Figure 16:
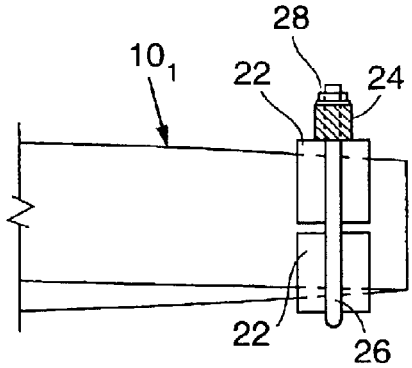
FIG. 16 is a side elevational view of the nail, end clamp and retaining bar of FIG. 15.

With the flanged proximal end $P_1$ of the FIG. 3 embodiment, connection to the proximal end of the nail may be provided by bolted attachment through the openings 18. With the unflanged embodiment, connection is achieved through means of an internal collet or an exterior clamp, at a location closely adjacent to the proximal end of the nail. A clamp is shown in FIG. 15. It comprises semicircular saddle elements 22 engagable over opposite sides of the body portion of the nail; a retaining bar 24 to one side of the body portion and one of the saddle elements; and, a U-bolt 26 engaged around the saddle elements 22. The U-bolt has distal ends extending through the retaining bar and threadably receives nuts 28 engaged with the external surface of the bar.

The pointed tips on the distal end of the nail may vary, depending upon the configuration of the body portion 10. In the case of a tubular nail of a polygonal cross-section, a tip can be formed as shown in FIGS. 17 and 18 by cutting mitered ends on the sides of the body, bending these ends together so that their edges meet, and then welding the edges together.

Figure 17:
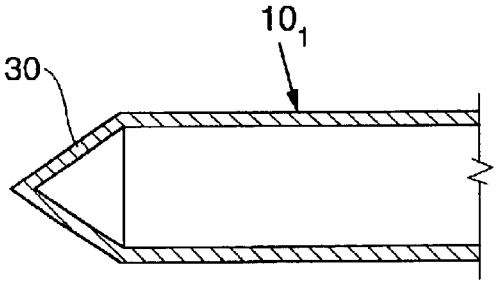
FIG. 17 is a cross-sectional side view of the distal end of a square nail constructed according to the invention, wherein a pointed tip is formed by mitered converging ends on the side walls of the nail.
Figure 18:
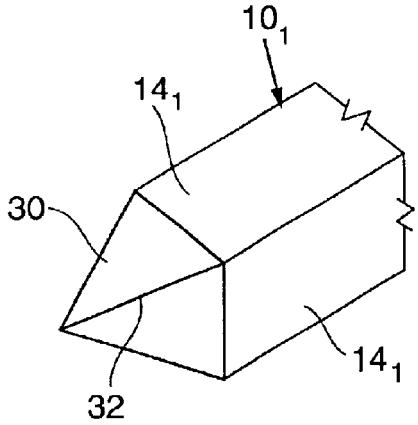
FIG. 18 is a perspective view of the distal end of the nail shown in FIG. 17.

The mitered ends in FIGS. 17 and 18 are designated by the numeral 30 and are shown as having welded edges 32.

Figure 19:
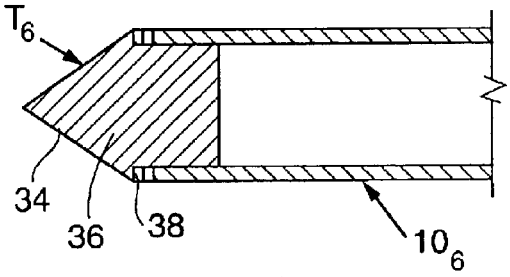
FIG. 19 is a cross-sectional side view of the distal end of a round nail constructed according to the invention wherein a conical pointed tip is secured to the nail.
Figure 20:
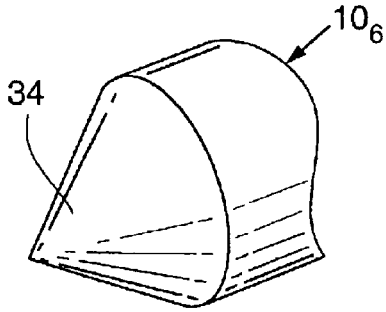
FIG. 20 is a perspective view of the distal end of the nail shown in FIG. 19.

FIGS. 19 and 20 show a tip construction for use with a nail having a cylindrical body portion $\mathbf{10}_6$. As there shown, the tip comprises a conical distal portion 34 having a base of a diameter equal to that of the outside diameter of the nail and a cylindrical extension 36 proportioned for receipt in the end of the body section $\mathbf{10}_6$. The tip may be pinned or welded in place. A shoulder 38 on the tip $T_6$ engages the end of the body section $\mathbf{10}_6$.

Wire Faced Wall

Figure 21:
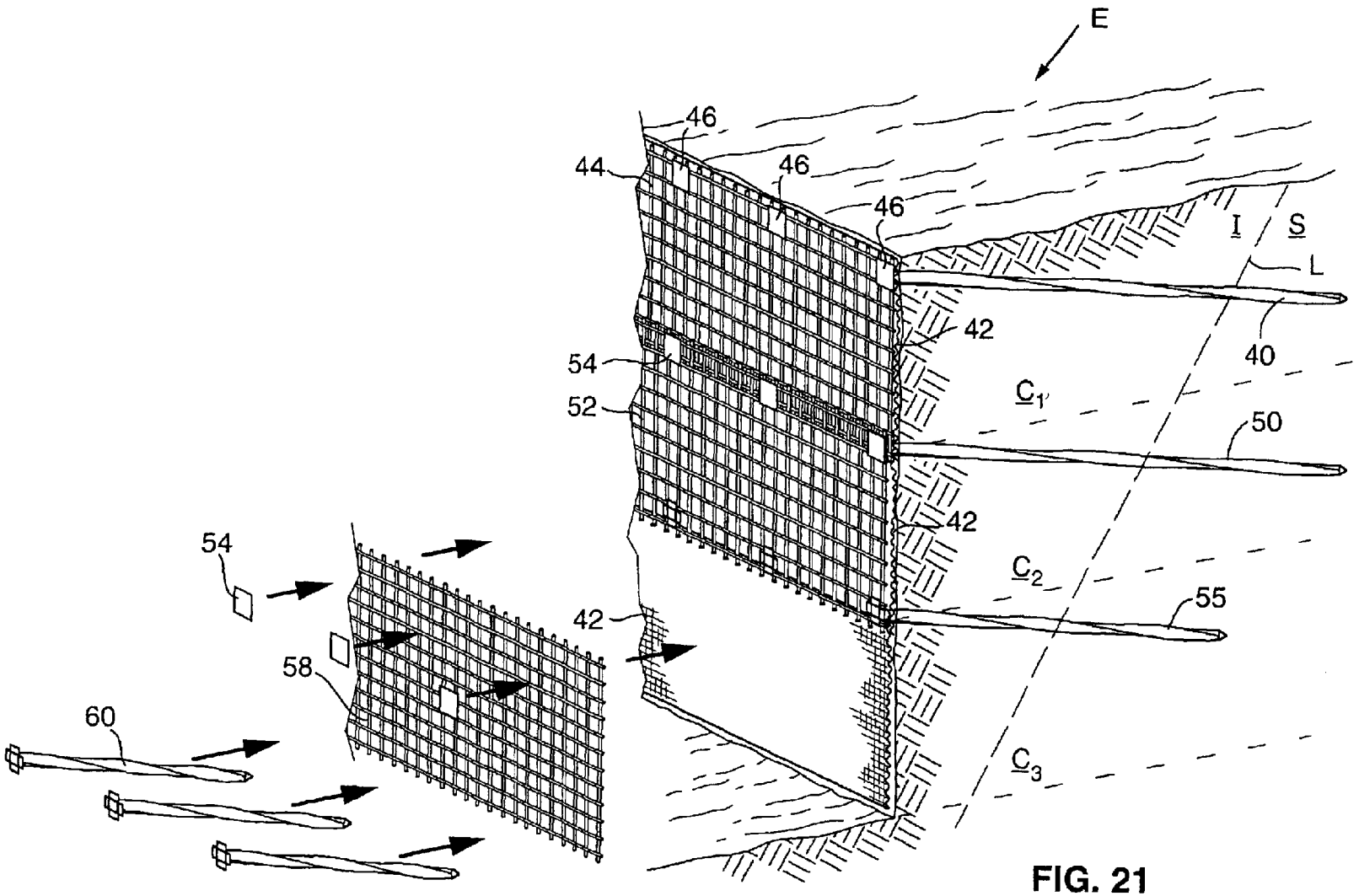
FIG. 21 is a cross-sectional perspective view, with parts thereof exploded, showing a soil reinforced earthen embankment constructed according to the invention, wherein the embankment is provided with welded wire face panels.

FIG. 21 shows the nails of the invention in the process of being used to construct a wire faced reinforced soil retention wall in the embankment for an earthen formation E. As there shown, the wall is being constructed from the top down in successive courses, designated $C_1$, $C_2$ and $C_3$. The dashed lines shown separating these courses in the drawings are for illustration only to distinguish one course from another and do not represent structure. Similarly, the failure plane depicted by the line L is not a physical structure, but rather represents the theoretical plane between the relatively unstable soil I near the face of the formation and the stable soil S at a depth within the formation. Both the stable and unstable areas are part of the formation being worked upon. Neither is backfill.

The first step of constructing the wall shown in FIG. 21 is to cut away the face of the formation at the course $C_1$ to provide a relatively flat face surface which may be generally vertical, as shown, or backwardly sloped. Upper nails 40 are then driven laterally into the formation at horizontally spaced intervals so as to extend through the unstable soil I into the stable soil S. During the course of driving the nails, they self-thread into place by turning about their longitudinal axes, thus gripping and adhering to the soil of the formation continually and evenly along their entire length. The angle at which the nails are driven into the formation may vary. As shown, the nails slope downwardly approximately 20° from horizontal. The horizontal spacing of the nails will also vary, depending upon the formation. The spacing needs to be such as to assure adequate reinforcement of the earthen formation being retained. A typical horizontal spacing is approximately five feet.

After the row of upper nails 40 is placed, the next step is to place a geotextile filtering cloth 42 over the cut face of the course $C_1$ and then to secure a welded wire face panel 44 over the filtering cloth by plates 46 disposed over the welded wire face and secured to the heads of the nails 40 by bolts 48. This sequence may be altered by attaching the cloth to the wire face panel first and then securing the panel to the formation, with the cloth sandwiched between the panel and the face of the formation.

Figure 22:
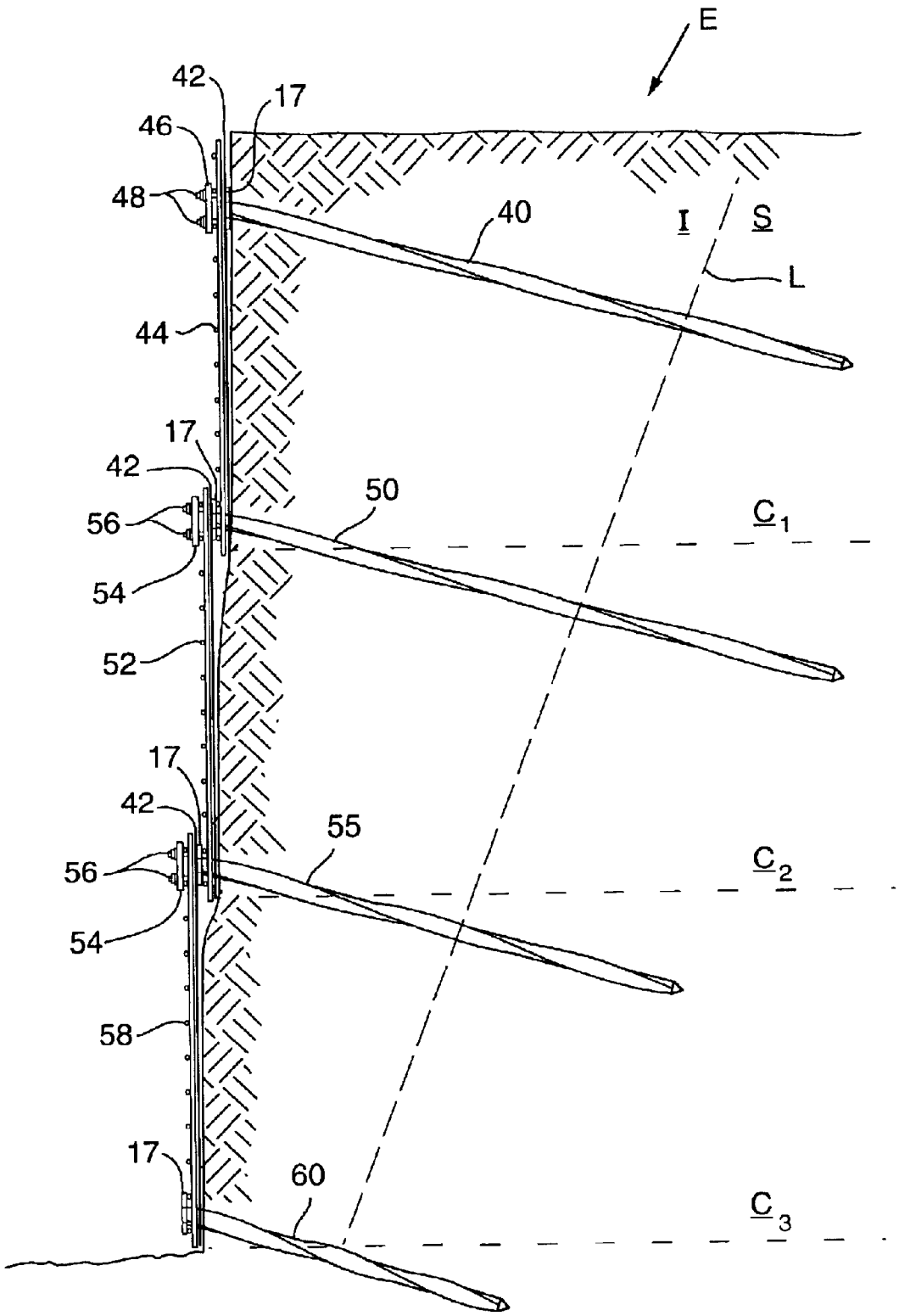
FIG. 22 is a cross-sectional elevational view of the soil reinforced embankment of FIG. 1.

The nails 40 shown in FIG. 22 have flanged heads thereon like those shown in FIG. 2. The bolts are carriage bolts engaged in openings 18 and extending therefrom through openings in the plates 46. Nuts on the bolts secure the plates in place.

After the welded wire face 44 is secured in place by connection to the upper row of nails 40, a second row of nails 50 is driven through the lower portion of the wire face so that the heads on the nails engage over the face. The welded wire face and the filtering cloth therebehind secure the face of the upper course $C_1$ against sloughing. With the upper course so conditioned, the face of the second course $C_2$ is cut and filter cloth 42 is placed thereover. A wire face panel 52 is then placed over the face of the course $C_2$ in a disposition wherein the upper end of the panel extends over the lower portion of the panel 44. The wire face panel 52 is then secured in place by plates 54 fastened to the heads of the nails 50 by bolts 56. The next successive row of nails 55 is then driven into place through the lower portion of the face panel 52, thus reinforcing the soil behind the panel and fastening the panel securely in place over the face of the course $C_2$.

With the panels 44 and 52 in place, the soil at the face of the courses $C_{1\ and\ C2}$ is held against sloughing and the face of the next successive course of soil $C_3$ is cut. Then, filtering cloth and a third wire face panel 58 is secured in place over the face of the course $C_3$ in a manner identical to that described with respect to the placement of the face panel over the face of the course $C_2$. FIG. 21 diagrammatically depicts this placement. There it will be seen that the upper portion of the panel 58 is secured to the heads of the nails 55 by plates 54 bolted thereto. Once the panel 58 is so connected to the nails 55, a row of nails 60 is driven through the panel 58 and into the formation.

While only three successive rows of face panels are illustrated in FIGS. 21 and 22, it should be understood that additional successive panels may be similarly placed, depending upon the depth of the embankment being retained. The wire face panels may have a desired grid pattern. A spacing of four inches by six inches or two inches by six inches is typical. Typically, the wire is W 4.5, measuring approximately one-quarter inch in diameter with welds at all intersections. For permanent walls, the wire is hot dipped galvanized for corrosion resistance.

Hammers

Figure 23:
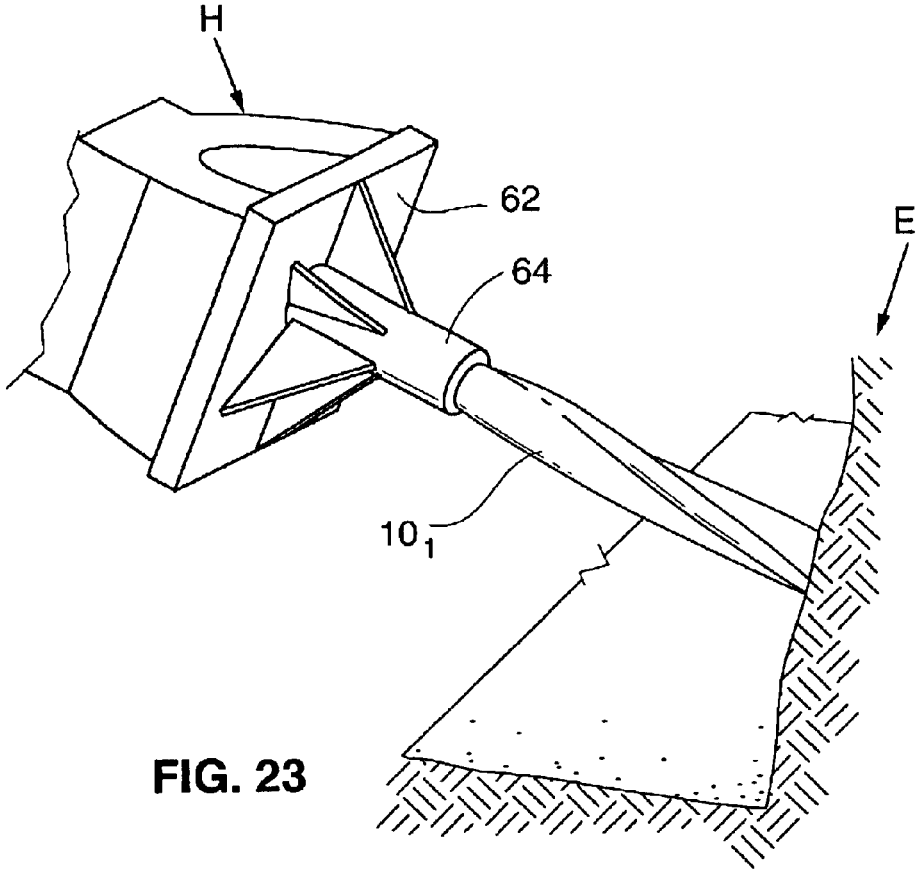
FIG. 23 is a perspective view diagrammatically illustrating an unheaded nail of the invention being driven into an earthen embankment with a vibratory hammer having a sleeve extending around the nail.

FIG. 23 shows a vibratory hammer H driving a nail $\mathbf{10}_1$ into the cut face of an earthen formation E. The anvil 62 of the hammer has a cylindrical extension 64 extending therefrom which receives the end of the nail $\mathbf{10}_1$ to hold the nail in alignment with the anvil, while permitting the nail to rotate freely about its longitudinal axis. In use, the anvil imparts repeated rectilinear hammering force to the proximal end of the nail, while permitting the nail to rotate about its longitudinal axis and screw into place within the formation.

Figure 24:
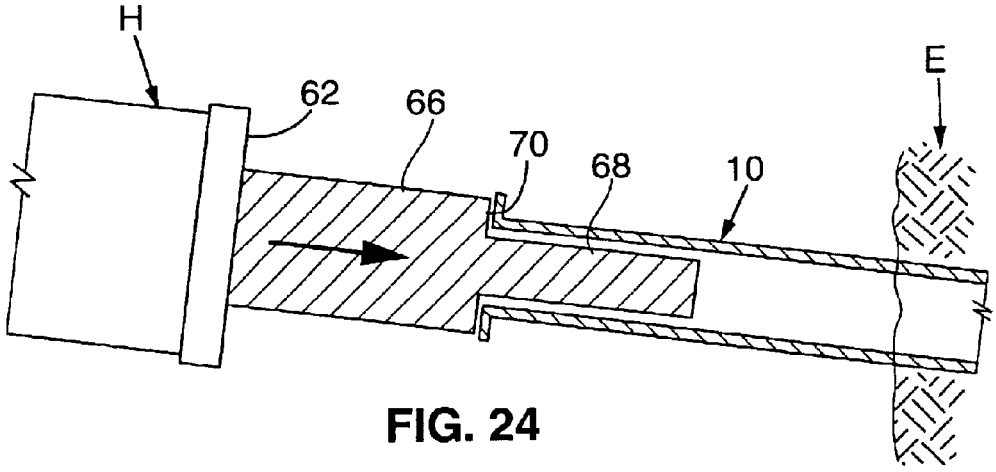
FIG. 24 is a side elevational view, with parts thereof shown in section, diagrammatically illustrating the open ended flanged nail of the invention being driven into an embankment with a vibratory hammer having a mandrel extending into the nail.

FIG. 24 shows a hammer H having an anvil 62 with a mandrel 66 extending therefrom with a reduced diameter cylindrical distal portion 68 proportioned for extension into the open end of a headed nail 10. The extension is proportioned for rotatable receipt in the nail 10, whereby the nail may freely rotate about its longitudinal axis as it is driven into place. A shoulder 70 on the mandrel 66 imparts vibratory rectilinear impact force to the nail from the hammer.

Nail Placement for Drainage

Figure 25:
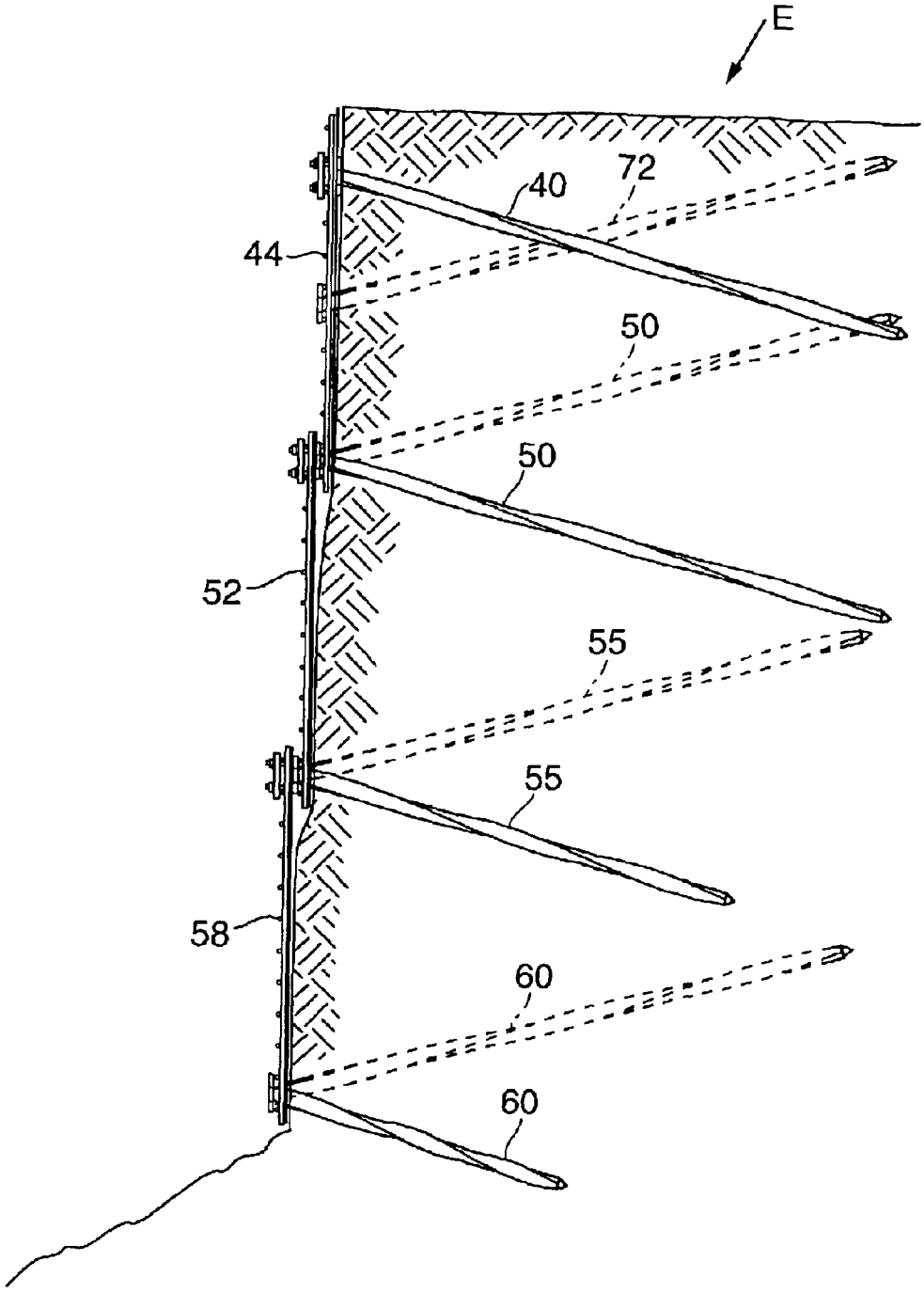
FIG. 25 is a cross-sectional elevational view similar to FIG. 22, illustrating a soil reinforced embankment constructed according to the invention wherein upwardly sloping nails are provided for purposes of drainage.

FIG. 25 shows a wall constructed in a manner corresponding to that of FIGS. 21 and 22, except that an additional row of upperwardly inclined nails 72 extends through the upper face panel 44 and that certain of the nails 50, 55 and 60 extend at an upward slope. The upperwardly sloping nails serve as soil reinforcements while, also, providing a path for drainage from the earthen formation.

Concrete Face Panel Embodiments

Figure 26:
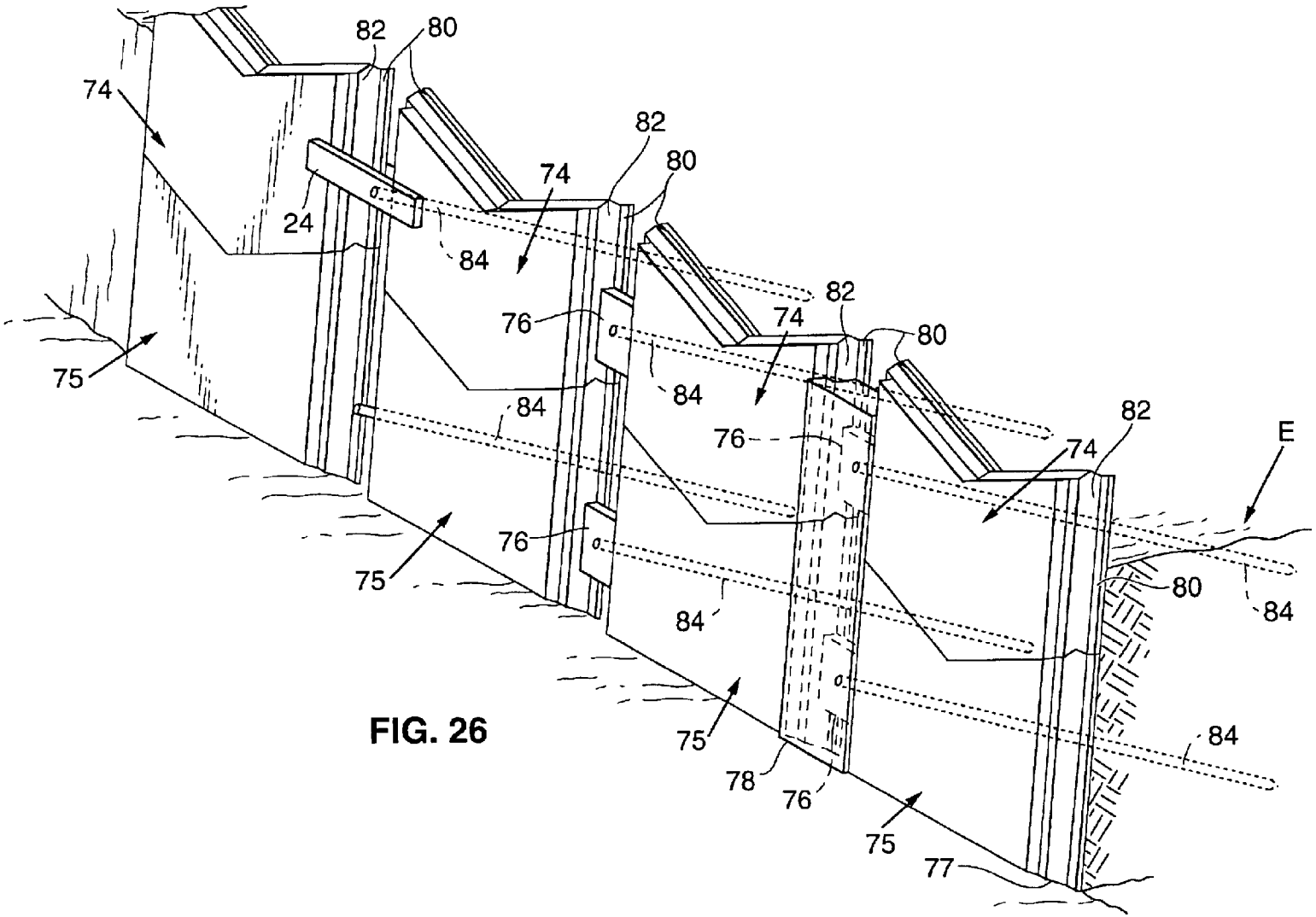
FIG. 26 is a perspective view, with parts thereof shown in section, showing a soil reinforced earthen embankment constructed according to the invention, wherein the embankment is provided with pre-cast concrete face panels held in place by brackets nailed to the embankment.

FIG. 26 shows an embodiment on the retaining wall of the invention having pre-cast concrete face panels 74 and 75. The panels 74 each comprise a generally chevron-shaped body formed with a stepped vertical edge construction for engagement by a brackets 76 which hold the panels in place and a filler column 78 used to cover the space between adjacent panels. The stepped edge construction provides a first flange 80 for engagement beneath the bracket 76 and a step 82 for engagement by the column 78. The column 78 has a stepped edge construction complimental to the edges of the panels.

The panels 75, hereinafter referred to as the lead lower panels, are complimental to the panels 74 and are formed with sloped lower surfaces 77 inclined upwardly relative to the sides of the panels which face the earthen formation. The edges of the panels 75 are of a stepped configuration corresponding to the edges of the panels 74.

The nails of the FIG. 26 wall are designated 84 and are driven into place in vertical rows spaced from one another horizontally by the width of the panels. The number of nails and their vertical spacing is determined by what is necessary for the nails to reinforce the soil of the earthen formation E being retained. After the nails are driven into place, the panels are positioned between the nails and the brackets 76 are secured to the proximal ends of the nails so as to engage over the flanges 80 of the panels and secure the panels in place against the face of the formation. Then, if it is desired to close the space between the panels, columns 78 are positioned between the panels and secured into place. The columns 78 may be preformed, or cast in place.

In the course of constructing a wall with concrete panels as shown in FIG. 26, the wall is constructed in successive courses from the top down through a sequence similar to that which has been shown and described with respect to FIG. 21. The sequence is different to the extent necessary to accommodate the above-described placement and securing of the concrete panels 74, 75, and the filling of the space therebetween. It also differs in that the panels 74, 75 slide down as each successive course is formed and in that additional panels 74 are then added to the top to make up the distance resulting from the downward sliding of the panels. The panels slide under the influence of gravity, as the earthen formation therebeneath is cut away. The sloped lower surfaces 77 of the lead lower panels 75 ease such sliding and settling of the panels. To further facilitate such sliding, the panels may temporarily be loosely secured to the nails by a retaining bar, such as the bar 24 shown in FIG. 15, before the brackets 76 are secured in placed. Like the embodiment of FIG. 21, the wall of FIG. 26 is constructed in successive courses from the top down, with the face of each course covered with panel elements, before construction of the next successive course is commenced. It has the added advantage that the cut face of the formation is covered in a substantially continuous sequence, as the panels slide down and settle into place.

Figure 27:
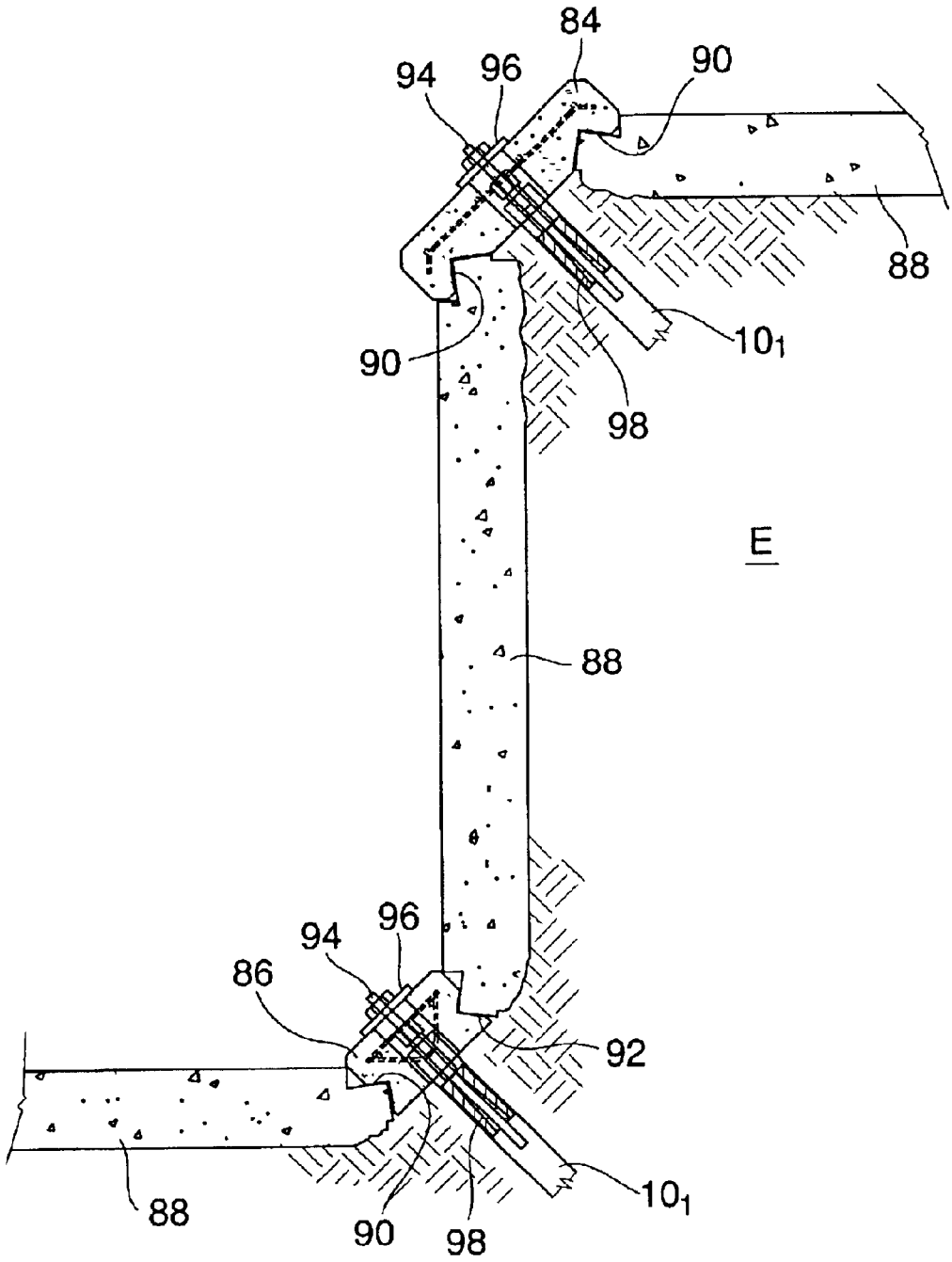
FIG. 27 is a cross-sectional plan view illustrating a soil reinforced earthen embankment constructed according to the invention wherein the embankment is provided with pre-cast concrete face panels which are slid into place behind columns nailed to the embankment.

FIG. 27 illustrates a concrete panel embodiment of the invention wherein the nails secure vertically extending columns 84 and 86 in place at horizontally spaced intervals corresponding to the width of the panels 88. The columns and panels have complimental rabbeted edges which enable the panels to be slid vertically into place behind the columns. In the embodiment shown, the columns 84 and 86 accommodate panels disposed at right angles to one another for the construction of a wall having such an angled configuration. Similar columns, however, could be designed to accommodate a generally planer wall.

The column 84 has rabbeted edges 90 to accommodate panels arranged to form an outside corner. The column 86 has rabbeted edges 92 to accommodate panels forming an inside corner.

The wall of FIG. 27 is constructed in successive courses, from the top down, similarly to the previously described embodiments. In constructing the wall, the face of the uppermost course is first cut and then the columns 84, 86 are secured in place by the nails 10 of the invention. The nails extend through openings provided therefor in the columns and are secured to the columns by bolts 94 engaged over washers 96; which bolts extend into secure engagement with the interior of the nails through collets 98. With the columns 84, 86 in place, the panels 88 are slid into place behind the rabbeted edges of the columns. The panels 88 may also be permitted to slide continuously down, similarly to the panels 74, 75 of the FIG. 26 embodiment, as the soil beneath the panels is cut away during construction of the wall.

Method and Apparatus for Forming Nails

Figure 28:
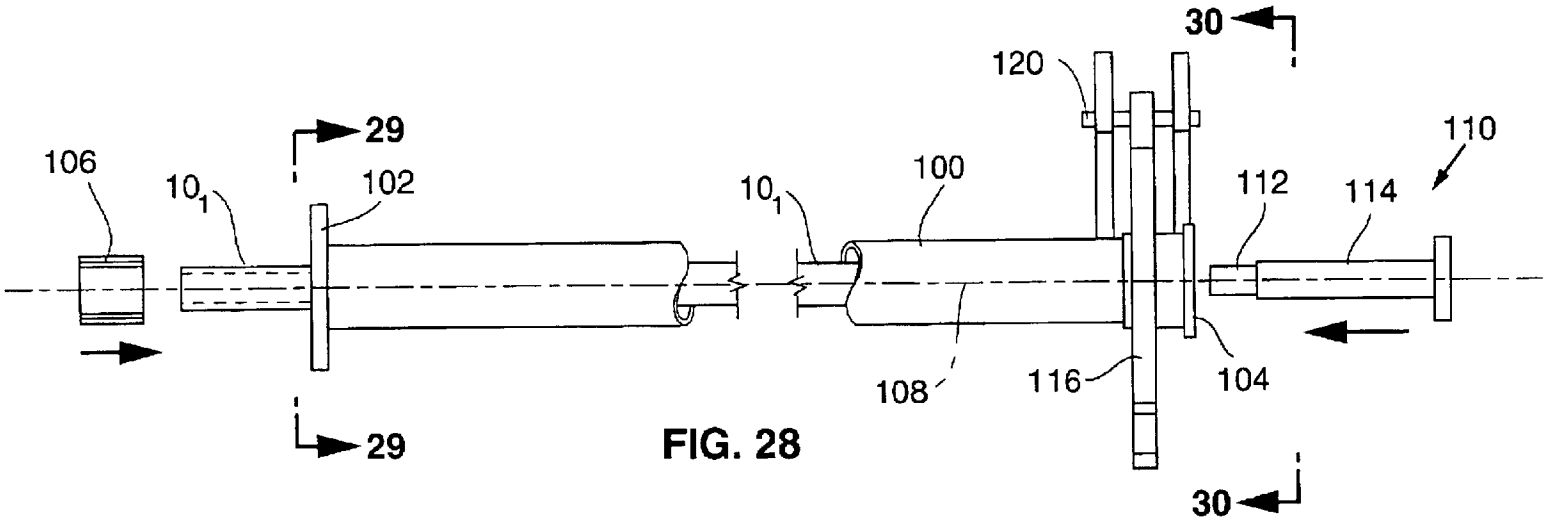
FIG. 28 is a side elevational view diagrammatically illustrating a mechanism for twisting a straight rectangular tube into a spiral shape for the nail of the invention.
Figure 30:
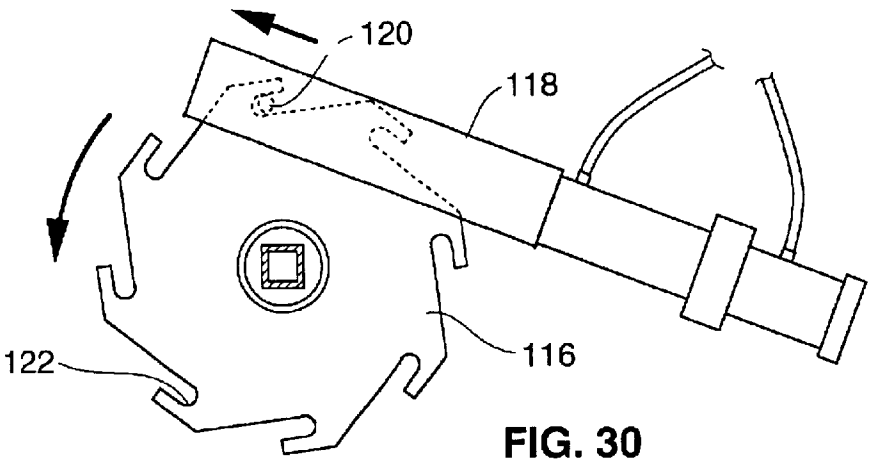
FIG. 30 is a cross-sectional view taken on the plane designated by line 30—30 of FIG. 28.
Figure 29:
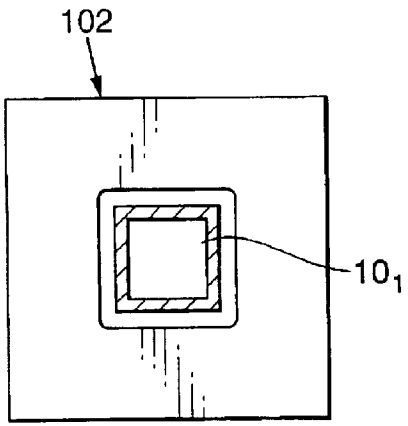
FIG. 29 is a cross-sectional view taken on the plane designated by line 29—29 of FIG. 28.

FIGS. 28 to 30 illustrate an apparatus for twisting a tubular nail of a square cross-section into the helical configuration of the invention. The apparatus comprises a cylindrical tube 100 having a fixed holding flange 102 at one end thereof and a rotatable twisting flange 104 at the other end thereof. As shown, a nail 10 extends through the tube from the fixed flange 102 to the rotatable twisting flange 104. An end lock 106 in the form of a square collet is slid over the end of the nail and engaged with the fixed holding flange to secure the end of the nail within that flange against rotation. The rotatable twisting flange 104 is mounted for rotation about the longitudinal axis 108 of the tube 100. The tube 100 is locked to the rotatable twisting flange 104 by an end lock 110 of a rectangular cross-section having an end 112 proportioned for complimental engagement inside the end of the nail 10 and an enlarged portion 114 proportioned for engagement with a complimental square opening provided therefor in the flange 104. The outside of the twisting flange 104 has a sprocket-like rotatable wheel 116 fixed thereto in concentric relationship to the axis 108. An hydraulic rotator arm 118 is pivotally mounted to one side of the wheel 116 and carries a pin 120 engagable with teeth 122 formed in the periphery of the wheel 116. The hydraulic rotator is expansible and contractible to engage successive teeth and impart twisting movement to the flange 104 through the wheel 116, as depicted by the arrow line in FIG. 30.

The apparatus of FIGS. 28 to 30, functions to cold form the body of the nail into a helical configuration. The pitch is determined by the extent to which the body of the nail is twisted by the hydraulic rotator. Once twisting is complete, the end locks 108 and 114 are disengaged from the nail and the nail is removed from the apparatus.

In the case of a nail having wires on its edges, such as the wires 19 of the FIGS. 7 and 8 embodiment, the wires could be welded to the edges of the tube in a straight condition, while the tube in the untwisted configuration. The tube would then be twisted with the apparatus of FIGS. 28 to 30 to cold form both the tube and the wires into the helical configuration.

Figure 31:
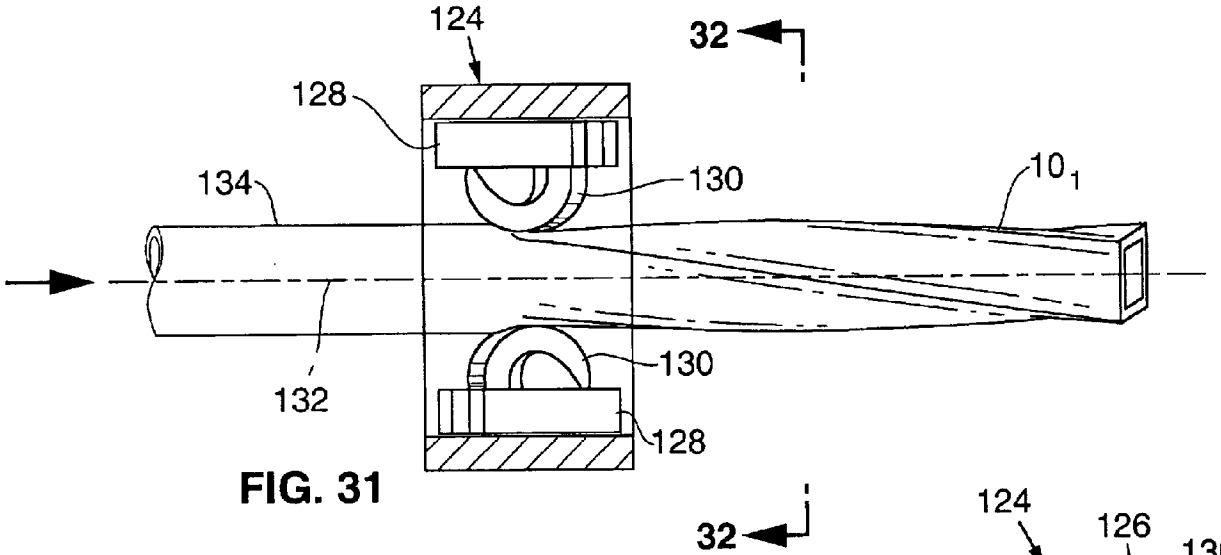
FIG. 31 is a side elevational view, with parts thereof shown in section, illustrating a mechanism for forming a round tube into a square twisted configuration for the nail of the invention.
Figure 32:
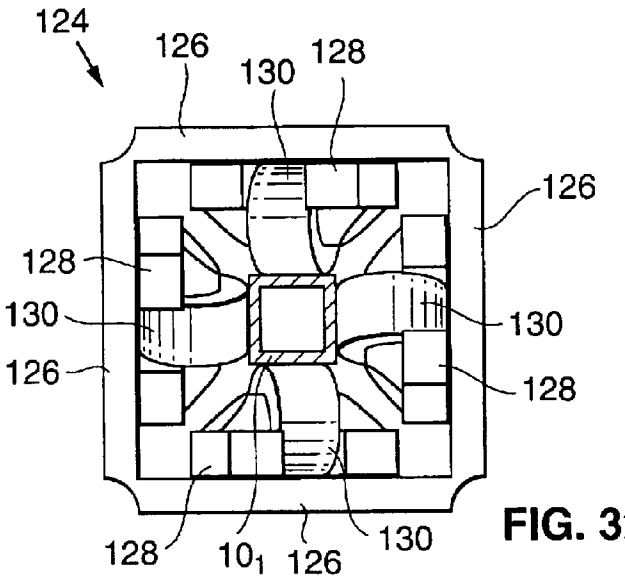
FIG. 32 is a cross-sectional end view taken on the plane designated by line 32—32 of FIG. 32; and, FIG. 33 is a perspective view of one of the roller assemblies used in the mechanism of FIG. 31.
Figure 33:
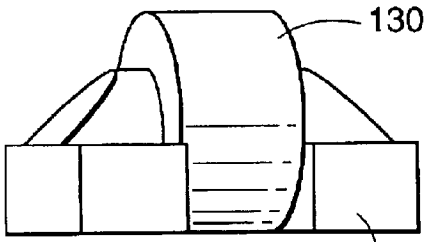

FIGS. 31 to 33 show an alternative apparatus for forming the nail of the invention. In this apparatus, the tube stock from which the nail is formed starts out as being cylindrical and is cold formed into a twisted rectangular configuration.

The apparatus of FIGS. 31 to 33 comprises a fixed box-frame 124 of an open square configuration having side walls 126. Roller assemblies comprising base mounts 128 fixed to the interior of the walls and rollers 130 carried by the mounts are disposed within the box-frame. These assemblies and the rollers carried thereby are skewed relative to the longitudinal axis 132 extending through the block frame.

FIG. 31 diagrammatically illustrates the apparatus therein in the course of forming a cylindrical tube into a twisted nail of a square cross-section. As there shown, the tube, designated 134, has a longitudinal axis coincident with axis 132 of the box-frame 124 and is the process of being forced between the rollers 130 from left to right. In this process, the rollers function to both squeeze the sides of the tube into a rectangular cross-sectional configuration and to twist the tube into a helical form. The skewed mounting of the roller assemblies achieves the twisting function. Compression into the rectangular form results from cold forming of the sides of the tube by the rollers 130.

Conclusion

From the foregoing description, it is believed apparent that the invention enables the attainment of the objects initially set forth herein. In particular, it provides a helical nail for soil reinforcement of an earthen formation which is placed by driving the nail laterally into the formation, whereby the nail screws into place and grips and adheres to the formation evenly along its entire length. It should be understood, however, that the invention is not intended to be limited to the specifics of the embodiments herein illustrated and described, but rather as defined by the accompanying claims.

We claim:

1. A soil reinforced earthen retaining wall comprising:

a. an earthen embankment having a face and successive upper and lower courses;

b. a first plurality of nails driven through the face and into the upper course at spaced intervals, the nails in the first plurality each having an elongate body with a generally spiral-shaped thread extending therearound screwed into place within the embankment, a distal end terminating within the embankment, and a proximal end at the face of the embankment;

c. face elements secured in place over the face at the upper course of the formation by connection to the proximal ends of the first plurality of nails;

d. a second plurality of nails driven through the face and into the lower course at spaced intervals, the nails in the second plurality each having an elongate body with a generally spiral-shaped thread extending therearound screwed into place within the embankment, a distal end terminating within the embankment, and a proximal end at the face of the embankment; and, e. face elements secured in place over the face at the lower course of the formation by connection to the proximal ends of the second plurality of nails; and wherein:

i. the body of each nail is tubular and has an outside cross-section of two or more inches; and, ii. the distal end of each nail is closed by a tip which converges to a point.

2. A soil reinforced earthen retaining wall comprising:

a. an earthen embankment having a face and successive upper and lower courses;

b. a first plurality of nails driven through the face and into the upper course at spaced intervals, the nails in the first plurality each having an elongate body with a generally spiral-shaped thread extending therearound screwed into place within the embankment, a distal end terminating within the embankment, and a proximal end at the face of the embankment;

c. face elements secured in place over the face at the upper course of the formation by connection to the proximal ends of the first plurality of nails;

d. a second plurality of nails driven through the face and into the lower course at spaced intervals, the nails in the second plurality each having an elongate body with a generally spiral-shaped thread extending therearound screwed into place within the embankment, a distal end terminating within the embankment, and a proximal end at the face of the embankment; and, e. face elements secured in place over the face at the lower course of the formation by connection to the proximal ends of the second plurality of nails; and wherein:

i. the body of each nail is tubular and has a longitudinal axis; and, ii. the proximal end of each nail is open to provide a socket into which a driver may extend to maintain alignment between the driver and the nail, while permitting the nail to freely rotate about the longitudinal axis.

3. A soil reinforced earthen retaining wall comprising:

a. an earthen embankment having a face and successive upper and lower courses;

b. a first plurality of nails driven through the face and into the upper course at spaced intervals, the nails in the first plurality each having an elongate body with a generally spiral-shaped thread extending therearound screwed into place within the embankment, a distal end terminating within the embankment, and a proximal end at the face of the embankment;

c. face elements secured in place over the face at the upper course of the formation by connection to the proximal ends of the first plurality of nails;

d. a second plurality of nails driven through the face and into the lower course at spaced intervals, the nails in the second plurality each having an elongate body with a generally spiral-shaped thread extending therearound screwed into place within the embankment, a distal end terminating within the embankment, and a proximal end at the face of the embankment; and, e. face elements secured in place over the face at the lower course of the formation by connection to the proximal ends of the second plurality of nails; and wherein:

i. the body of each nail is of a tubular polygonal cross-section with adjacent generally flat outside surfaces; and, ii. flanges extend outwardly from at outside surfaces at the proximal ends of the nails to provide a head.

4. A soil reinforced earthen retaining wall comprising:

a. an earthen embankment having a face and successive upper and lower courses;

b. a first plurality of nails driven through the face and into the upper course at spaced intervals, the nails in the first plurality each having an elongate body with a generally spiral-shaped thread extending therearound screwed into place within the embankment, a distal end terminating within the embankment, and a proximal end at the face of the embankment;

c. face elements secured in place over the face at the upper course of the formation by connection to the proximal ends of the first plurality of nails;

d. a second plurality of nails driven through the face and into the lower course at spaced intervals, the nails in the second plurality each having an elongate body with a generally spiral-shaped thread extending therearound screwed into place within the embankment, a distal end terminating within the embankment, and a proximal end at the face of the embankment; and, e. face elements secured in place over the face at the lower course of the formation by connection to the proximal ends of the second plurality of nails; and wherein:

i. the body of each nail is of a cylindrical configuration and the thread is formed around and extends outwardly from the body; and, ii. the thread comprises a wire fixed to and extending outwardly around the body in a helical configuration.

5. A soil reinforced earthen retaining wall comprising:

a. an earthen embankment having a face and successive upper and lower courses;

b. a first plurality of nails driven through the face and into the upper course at spaced intervals, the nails in the first plurality each having an elongate body with a generally spiral-shaped thread extending therearound screwed into place within the embankment, a distal end terminating within the embankment, and a proximal end at the face of the embankment;

c. face elements secured in place over the face at the upper course of the formation by connection to the proximal ends of the first plurality of nails;

d. a second plurality of nails driven through the face and into the lower course at spaced intervals, the nails in the second plurality each having an elongate body with a generally spiral-shaped thread extending therearound screwed into place within the embankment, a distal end terminating within the embankment, and a proximal end at the face of the embankment; and, e. face elements secured in place over the face at the lower course of the formation by connection to the proximal ends of the second plurality of nails; and wherein:

i. the face elements comprise preformed concrete panels;

ii. the panels are secured to the proximal ends of the nails by brackets carried by the nails which engage edge portions of the panels;

iii the edge portions of the panels are disposed in spaced relationship;

iv fillers are disposed between the panels; and, v. the fillers comprise cast in place concrete columns formed between the panels.

6. A soil reinforced earthen retaining wall comprising:

a. an earthen embankment having a face and successive upper and lower courses;

b. a first plurality of nails driven through the face and into the upper course at spaced intervals, the nails in the first plurality each having an elongate body with a generally spiral-shaped thread extending therearound screwed into place within the embankment, a distal end terminating within the embankment, and a proximal end at the face of the embankment;

c. face elements secured in place over the face at the upper course of the formation by connection to the proximal ends of the first plurality of nails;

d. a second plurality of nails driven through the face and into the lower course at spaced intervals, the nails in the second plurality each having an elongate body with a generally spiral-shaped thread extending therearound screwed into place within the embankment, a distal end terminating within the embankment, and a proximal end at the face of the embankment; and, e. face elements secured in place over the face at the lower course of the formation by connection to the proximal ends of the second plurality of nails; and wherein:

i. the face elements comprise preformed concrete panels ii. preformed columns are disposed between the face panels and secured to the embankment by the nails; and, iii. the columns have portions extending over edge portions of the panels to secure panels in place over the face of the formation.

7. A retaining wall according to claim 6 wherein the columns and panels are so configured as to enable the edge portions of the panels to be slid into place behind the portions of the columns extending thereover.

8. A soil reinforced earthen retaining wall comprising:

a. an earthen embankment having a face and successive upper and lower courses;

b. a first plurality of nails driven through the face and into the upper course at spaced intervals, the nails in the first plurality each having an elongate body with a generally spiral-shaped thread extending therearound screwed into place within the embankment, a distal end terminating within the embankment, and a proximal end at the face of the embankment;

c. face elements secured in place over the face at the upper course of the formation by connection to the proximal ends of the first plurality of nails;

d. a second plurality of nails driven through the face and into the lower course at spaced intervals, the nails in the second plurality each having an elongate body with a generally spiral-shaped thread extending therearound screwed into place within the embankment, a distal end terminating within the embankment, and a proximal end at the face of the embankment;

e. face elements secured in place over the face at the lower course of the formation by connection to the proximal ends of the second plurality of nails; and f. wherein at least certain of the nails slope upwardly for drainage purposes.

9. A soil reinforced earthen retaining wall comprising:

a. an earthen embankment having a face;

b. a plurality of nails driven laterally through the face and into the embankment at spaced intervals, said nails each having an elongate body with a generally spiral-shaped thread extending therearound screwed into place within the embankment, a distal end terminating within the embankment, and a proximal end at the face of the embankment;

c. a face element secured in place over the face by connection to the proximal ends of the nails; and wherein:

i. the body of each nail is tubular and has an outside cross-section of two or more inches; and, ii. the distal end of each nail is closed by a tip which converges to a point.

10. A soil reinforced earthen retaining wall comprising:

a. an earthen embankment having a face;

b. a plurality of nails driven laterally through the face and into the embankment at spaced intervals, said nails each having an elongate body with a generally spiral-shaped thread extending therearound screwed into place within the embankment, a distal end terminating within the embankment, and a proximal end at the face of the embankment;

c. a face element secured in place over the face by connection to the proximal ends of the nails; and wherein:

i. the body of each nail is tubular and has a longitudinal axis; and, ii. the proximal end of each nail is open to provide a socket into which a driver may extend to maintain alignment between the driver and the nail, while permitting the nail to freely rotate about the longitudinal axis.

11. A soil reinforced earthen retaining wall comprising:

a. an earthen embankment having a face;

b. a plurality of nails driven laterally through the face and into the embankment at spaced intervals, said nails each having an elongate body with a generally spiral-shaped thread extending therearound screwed into place within the embankment, a distal end terminating within the embankment, and a proximal end at the face of the embankment;

c. a face element secured in place over the face by connection to the proximal ends of the nails; and wherein:

i. the body of each nail is of a twisted tubular polygonal cross-section with adjacent flat outside surfaces which intersect to define the thread extending around the body.

12. A soil reinforced earthen retaining wall comprising:

a. an earthen embankment having a face;

b. a plurality of nails driven laterally through the face and into the embankment at spaced intervals, said nails each having an elongate body with a generally spiral-shaped thread extending therearound screwed into place within the embankment, a distal end terminating within the embankment, and a proximal end at the face of the embankment;

c. a face element secured in place over the face by connection to the proximal ends of the nails; and wherein:

i. the body of each nail is of a tubular polyhedral cross-section and has outside surfaces which intersect in helically extending edges; and, ii. a wire is secured along at least one of the edges to define a spiral-shaped thread extending around the body.

13. A soil reinforced earthen retaining wall comprising:

a. an earthen embankment having a face;

b. a plurality of nails driven laterally through the face and into the embankment at spaced intervals, said nails each having an elongate body with a generally spiral-shaped thread extending therearound screwed into place within the embankment, a distal end terminating within the embankment, and a proximal end at the face of the embankment;

c. a face element secured in place over the face by connection to the proximal ends of the nails; and wherein:

i. the body of each nail is of a tubular polygonal cross-section with adjacent generally flat outside surfaces; and, ii. flanges extend outwardly from at outside surfaces at the proximal ends of the nails to provide a head.

14. A soil reinforced earthen retaining wall comprising:

a. an earthen embankment having a face;

b. a plurality of nails driven laterally through the face and into the embankment at spaced intervals, said nails each having an elongate body with a generally spiral-shaped thread extending therearound screwed into place within the embankment, a distal end terminating within the embankment, and a proximal end at the face of the embankment;

c. a face element secured in place over the face by connection to the proximal ends of the nails; and wherein:

i. the body of each nail is of a cylindrical configuration and the thread is formed around and extends outwardly from the body.

15. A retaining wall according to claim 14 wherein the thread comprises a wire fixed to and extending outwardly around the body in a helical configuration.

16. A soil reinforced earthen retaining wall comprising:

a. an earthen embankment having a face;

b. a plurality of nails driven laterally through the face and into the embankment at spaced intervals, said nails each having an elongate body with a generally spiral-shaped thread extending therearound screwed into place within the embankment, a distal end terminating within the embankment, and a proximal end at the face of the embankment;

c. a face element secured in place over the face by connection to the proximal ends of the nails; and wherein:

i. the face element comprises preformed concrete panels;

ii. the panels are secured to the proximal ends of the nails by brackets carried by the nails which engage edge portions of the panels;

iii. the edge portions of the panels are disposed in spaced relationship;

iv. fillers are disposed between the panels; and v. the fillers comprise cast in place concrete columns formed between the panels.

17. A soil reinforced earthen retaining wall comprising:

a. an earthen embankment having a face;

b. a plurality of nails driven laterally through the face and into the embankment at spaced intervals, said nails each having an elongate body with a generally spiral-shaped thread extending therearound screwed into place within the embankment, a distal end terminating within the embankment, and a proximal end at the face of the embankment;

c. a face element secured in place over the face by connection to the proximal ends of the nails; and wherein:

i. the face elements comprise element comprises preformed concrete panels;

ii. preformed columns are disposed between the face panels and secured to the embankment by the nails; and, iii. the columns have portions extending over edge portions of the panels to secure panels in place over the face of the formation.

18. A retaining wall according to claim 17 wherein the columns and panels are so configured as to enable the edge portions of the panels to be slid into place behind the portions of the columns extending thereover.

19. A method of constructing a soil reinforced retaining wall for an earthen embankment, said method comprising:

a. providing nails having generally spiral-shaped threads extending theraround of such proportions and pitch that the nails will turn and screw into place in an earthen formation in response to being driven into the formation by generally rectilinear force;

b. driving the nails into the embankment at spaced intervals to screw the nails into gripping engagement with the soil of the embankment;

c. securing face elements in place over the embankment by fastening said elements to the nails; and d. providing generally parallel spaced columns at the face of the embankment and wherein:

i. the nails are driven into the embankment through the columns and serve to secure the columns to the embankment;

ii. the face elements comprise preformed concrete panels slid into place between the columns; and, iii. the panels are secured in place over the embankment by interengagement with the columns as the panels are slid into place.

20. A method of constructing a soil reinforced retaining wall for an earthen embankment, said method comprising:

a. providing nails having generally spiral-shaped threads extending therearound of such proportions and pitch that the nails will turn and screw into place in an earthen formation in response to being driven into the formation by generally rectilinear force;

b. driving the nails into the embankment at spaced intervals to screw the nails into gripping engagement with the soil of the embankment;

c. securing face elements in place over the embankment by fastening said elements to the nails and, wherein:

d. at least certain of the nails are driven into the embankment in upwardly sloping orientation for drainage purposes.

* * * * *